US011136717B1

(12) United States Patent
Jewitt et al.

(10) Patent No.: US 11,136,717 B1
(45) Date of Patent: Oct. 5, 2021

(54) DRYING SECTION OF A PAPERMAKING MACHINE COMPRISING ONE OR MORE THROUGH AIR DRYING CYLINDERS

(71) Applicant: VALMET AKTIEBOLAG, Sundsvall (SE)

(72) Inventors: Dennis Jewitt, Sevenoaks (GB); Mattias Johansson, Kil (SE); Scott McClure Wightwick, Safety Beach (AU); Anders Lindén, Karlstad (SE); Martin Emanuelsson, Skoghall (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 17/289,481

(22) PCT Filed: Nov. 19, 2018

(86) PCT No.: PCT/SE2018/051198
§ 371 (c)(1),
(2) Date: Apr. 28, 2021

(87) PCT Pub. No.: WO2020/106193
PCT Pub. Date: May 28, 2020

(51) Int. Cl.
*D21F 7/12* (2006.01)
*D21F 5/18* (2006.01)
*D21F 1/32* (2006.01)

(52) U.S. Cl.
CPC ..... *D21F 5/181* (2013.01); *D21F 1/32* (2013.01); *D21F 7/12* (2013.01)

(58) Field of Classification Search
USPC ..... 162/207, 232
See application file for complete search history.

(56) References Cited

U.S. PATENT DOCUMENTS 3,691,010 A 9/1972 Krake
5,520,782 A 5/1996 Schiel
(Continued)

FOREIGN PATENT DOCUMENTS

EP 2126203 B1 6/2012
EP 2963176 B1 3/2017
(Continued)

OTHER PUBLICATIONS

International Searching Authority, International Search Report and Written Opinion received for International Application No. PCT/SE2018/051198, dated Jul. 19, 2019, 10 pages, Swedish Patent and Registration Office, Sweden.

*Primary Examiner* — Mark Halpern
(74) *Attorney, Agent, or Firm* — Alston & Bird LLP

(57) ABSTRACT

The invention relates to a drying section and comprises one or more through air drying cylinders 3, 5 and a permeable fabric 9 that runs in a loop and wraps part of the circumference of each through air drying cylinder. The loop of the fabric 9 is divided in a web-carrying part 10 and a conditioning part 11. The web-carrying part extends from a receiving point 12 to a transfer point 15 where a fibrous web is transferred to a further component. The conditioning part extends from the transfer point 15 to the receiving point 12. The conditioning part has a cleaning section 19 comprising a shower 20 to wash residue from the fabric. A dewatering section 21 is arranged to act on the fabric 9 after the cleaning section and comprises one or several suction dewatering devices 22. An applicator section 23 is arranged in the conditioning part 11 after the dewatering section. The applicator section comprises an applicator 24 for applying release agent on the fabric 9. The dewatering section 21 of the fabric loop comprises a substantially vertical run VR of the fabric which does not deviate more than 30° from a vertical plane and a suction dewatering device 22 is placed along the
(Continued)

vertical run of the fabric 9 on the web-contacting side of the fabric 9. The dewatering section either comprises a further suction dewatering device placed along the vertical run of the fabric on the side of the fabric 9 that is opposite the web-contacting side or it has room for installing a further suction dewatering device of the same size as the suction dewatering device 22 that is located on the web-contacting side of the fabric.

12 Claims, 10 Drawing Sheets

(56) References Cited

U.S. PATENT DOCUMENTS

| | | | |
|---|---|---|---|
| 5,554,467 | A | 9/1996 | Trokhan et al. |
| 5,901,918 | A | 5/1999 | Klerelid et al. |
| 6,425,981 | B1 | 7/2002 | Jewitt |
| 6,440,273 | B1 | 8/2002 | Jewitt |
| 6,451,171 | B1 | 9/2002 | Jewitt |
| 7,114,529 | B2 | 10/2006 | Johnson et al. |
| 7,303,655 | B2 | 12/2007 | Jewitt |
| 9,422,666 | B2 | 8/2016 | Patel et al. |

FOREIGN PATENT DOCUMENTS

| | | | |
|---|---|---|---|
| WO | WO 2017/082788 | A1 | 5/2017 |
| WO | WO 2017/139125 | A1 | 8/2017 |

DRYING SECTION OF A PAPERMAKING MACHINE COMPRISING ONE OR MORE THROUGH AIR DRYING CYLINDERS

CROSS REFERENCE TO RELATED APPLICATIONS

This application is a National Stage Application, filed under 35 U.S.C. § 371, of International Application No. PCT/SE2018/051198, filed Nov. 19, 2018; the contents of which as are hereby incorporated by reference in their entirety.

BACKGROUND

Related Field

The present invention relates to a drying section of a papermaking machine which drying section comprises one or more through air drying cylinders, i.e. a TAD drying section.

Description of Related Art

In a papermaking machine using through-air drying (TAD), a permeable fabric carries a fibrous web over one or a plurality of through-air drying cylinders (TAD cylinders) and air (usually hot air) is blown or drawn through the fibrous web. During the process of drying, cellulosic fibres and chemicals tend to be caught in the permeable fabric that carries the fibrous web. If nothing is done to counteract this, the permeability of the fabric will be progressively reduced which in turn leads to reduced and uneven drying and which may also increase the risk that web transfer will not function properly. In order to avoid this, the fabric is reconditioned in a process in which fibre residue and/or chemicals are removed from the fabric. U.S. Pat. No. 6,440,273 discloses the need for fabric cleaning in a paper making machine utilizing through air drying cylinders. U.S. Pat. No. 6,451,171 discloses a device for fabric dewatering which may be used in a machine using through-air drying. U.S. Pat. No. 7,303,655 discloses a system for conditioning a fabric in a paper making machine using through-air drying. That patent discloses how the fabric may be cleaned by showers and subsequently dewatered. It is an object of the present invention to provide a drying section for a paper making machine which drying section uses through-air drying cylinders and has an adequate system for fabric conditioning.

BRIEF SUMMARY

The present invention relates to a drying section of a paper making machine which drying section is designed to perform drying of a fibrous web. The inventive drying section of a paper making machine comprises one, two or more through air drying cylinders (TAD cylinders) each of which has an outer circumference and which through air drying cylinder (or cylinders) is (are) arranged to be rotatable. The drying section further comprises a fabric that is permeable to air and arranged to run in a loop and which wraps a part of the outer circumference of each through air drying cylinder. The fabric is further arranged to run in a predetermined direction of movement and the loop of the fabric is divided in a web-carrying part in which the fabric wraps the through air cylinder or cylinders and a conditioning part. One side of the fabric is arranged to contact the fibrous web in the web-carrying part and constitutes a web-contacting side of the fabric. The web-carrying part extends from a receiving point to a transfer point where the drying section of the paper making machine is designed to transfer the fibrous web from the fabric to a further machine component. The receiving point may be a pick-up point where a suction device inside the loop of the fabric is arranged to pick up a still wet fibrous web from a previous section or it may be a point on the fabric where the fibrous web is first formed if the fabric also serves as a forming fabric. The conditioning part of the fabric loop extends in the predetermined direction of movement of the fabric from the transfer point to the receiving point. For each through air drying cylinder, the inventive drying section has a hood that covers the part of the outer circumference of the through air drying cylinder about which the fabric is wrapped. The inventive drying section also comprises a plurality of lead rolls supporting the fabric in its loop. In the conditioning part of the fabric loop, there is a cleaning section that comprises at least one shower arranged to act on the fabric to wash away contaminants such as fibre residue and chemicals from the fabric and a pair of seals located opposite each other on each side of the fabric which pair of seals is located at the end of the cleaning section and defines the end of the cleaning section. In the conditioning part of the fabric loop, there is also a dewatering section that is arranged to act on the fabric in the conditioning part of the fabric loop to dewater the fabric in an area that lies after the cleaning section in the predetermined direction of movement of the fabric. The dewatering section comprises one or several suction dewatering devices including but not limited to suction dewatering boxes and/or air knives. Furthermore, an applicator section is also arranged in the conditioning part of the fabric loop in an area that lies after the dewatering section in the predetermined direction of movement of the fabric. The applicator section comprises at least one applicator that is arranged to apply a release agent on the fabric for facilitating release of a fibrous web from the fabric at a later stage after the fibrous web has been dried on said one or more through air drying cylinders. According to an important aspect of the invention, the dewatering part of the fabric loop comprises a vertical run of the fabric and at least one suction dewatering device that is placed along the vertical run of the fabric and located on the web-contacting side of the fabric such that it can perform dewatering on the web-contacting side of the fabric. Furthermore, the dewatering section either comprises an additional suction dewatering device placed along the vertical run of the fabric on the side of the fabric that is opposite the web-contacting side or that the dewatering section is dimensioned and designed such that it has room for installing (on the side opposite the web-contacting side of the fabric) an additional suction dewatering device of at least the same size as the suction dewatering device that is located on the web-contacting side of the fabric. The predetermined direction of movement of the fabric in the vertical run of the fabric loop along which the at least one suction dewatering device is placed is an upward direction.

In preferred embodiments of the invention, the dewatering section comprises at least two suction dewatering devices that are placed on opposite sides of the fabric such that dewatering can be performed from both sides of the fabric.

In advantageous embodiments, the fabric wraps a lead roll at the beginning of the part of the fabric loop where the fabric extends vertically, and two doctors may preferably be arranged to act on that lead roll to remove contaminants from that lead roll. When two doctors are placed to act against that roll, a misting shower may advantageously be arranged between the two doctors.

With regard to the cleaning section, at least a part of the cleaning section may advantageously be arranged in a part of the fabric loop in which the predetermined direction of movement of the fabric is a downward direction.

The inventive drying section has a machine direction defined as the direction in which it is arranged to carry the fibrous web through itself. In advantageous embodiments, the inventive drying section may further comprise a Yankee drying cylinder with a smooth outer surface. In embodiments comprising a Yankee drying cylinder, the fabric will be arranged to transfer the fibrous web at the transfer point (i.e. the transfer point where the drying section is designed to transfer the fibrous web from the fabric to a further machine component) to either the smooth outer surface of the Yankee drying cylinder or to a transfer fabric which is arranged to carry the fibrous web from the transfer point to the smooth outer surface of the Yankee drying cylinder. The conditioning part of the fabric loop is preferably located in a position vertically above the web-carrying part of the fabric loop and a suction and blowing device may advantageously be located above the conditioning part of the fabric loop and be arranged to suck in air and blow it away in a direction which is horizontal and perpendicular to the machine direction. A hood may optionally be placed over at least a part of the conditioning part of the fabric loop to prevent fibre residue to fall on the conditioning part of the fabric loop and to remove excessive mist. If a suction/blowing device and a hood are placed over the conditioning part of the fabric loop, the suction/blowing device may advantageously be integrated with the hood.

In advantageous embodiments, the last part of the cleaning section is located on a part of the fabric run of the fabric which part of the fabric run is substantially horizontal and which substantially horizontal part of the fabric run is either horizontal or does not deviate from a horizontal plane by more than 15° and extends between two lead rolls. The pair of seals that defines the end of the cleaning section are then located at a point of the part of the fabric run that is substantially horizontal and extends between two lead rolls. A pan may then be arranged above part of the fabric run that is substantially horizontal and extends between two lead rolls.

Preferably, an initial part of the cleaning section is located on a part of the fabric run that is vertical and precedes the substantially horizontal part of the fabric run above which the pan is arranged. A blade/foil may then be arranged in that vertical part of the fabric run and this blade/foil would be arranged to act against the fabric to wipe off water from the fabric and guide water and contaminants that have been wiped from the fabric into the pan.

The pan has a bottom wall that faces the fabric. Preferably, at least one shower is arranged to wash away fibre residue from the bottom wall.

In some embodiments of the invention, the shortest distance in the predetermined direction of movement of the fabric between the pair of seals that defines the end of the cleaning section and a suction dewatering device in the dewatering section may be selected to lie in the range of 2.5 m-6 m, preferably in the range of 3 m-5 m.

DETAILED DESCRIPTION OF VARIOUS EMBODIMENTS

Figure 1:
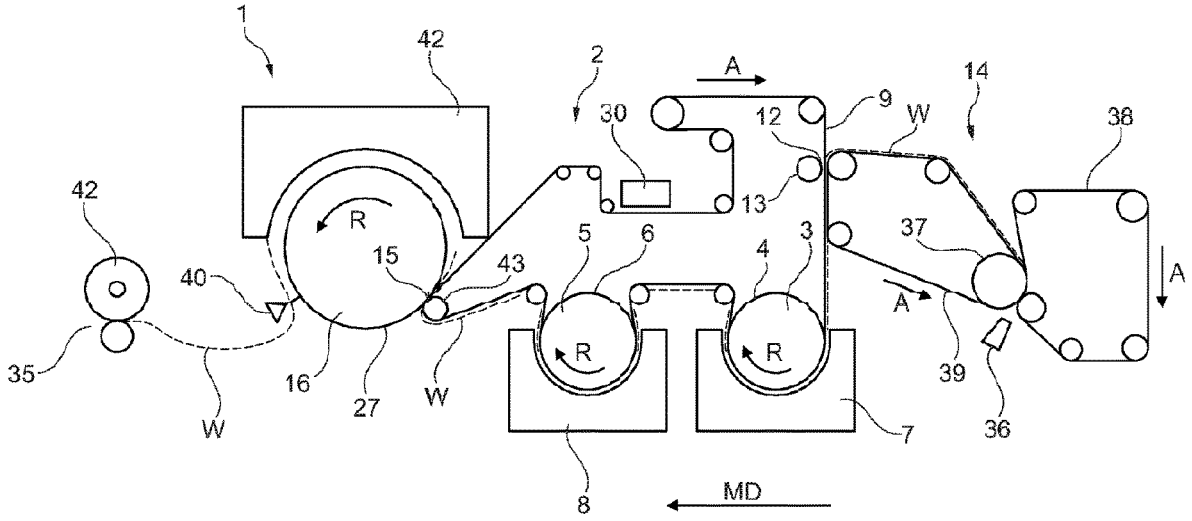
FIG. 1 shows the layout of a paper making machine in which the inventive drying section may be used.

With reference to FIG. 1, a paper making machine 1 is shown in which the inventive drying section 2 may be used. The drying section 2 is designed to perform drying of a fibrous web W. The paper making machine 1 of FIG. 1 comprises a forming section 14 in which a head box 36 is arranged to inject stock into a gap between a first forming fabric 38 and a second forming fabric 39. The forming fabrics 38, 39 may be forming wires. A forming roll 37 is shown as being placed within the loop of the second forming fabric 39. During operation of the paper making machine 1, the forming fabrics 38, 39 will move in the direction indicated by arrows "A". A fibrous web W is formed between the forming fabrics 38, 39 and the still wet fibrous web W will be carried by the second forming fabric 39 to the receiving point 12 for a fabric 9 where the fibrous web W is transferred to the fabric 9. In this embodiment, the receiving point 12 can also be named pick-up point since the fibrous web W is picked up at this point by the fabric 9. The transfer to the fabric 9 can be assisted by a suction device 13 such as a suction roll as indicated in FIG. 1 but the suction device 13 may also be a suction box/vacuum box. A molding box 52 is arranged inside the loop of the fabric 9. The fabric 9 which is permeable to air and is q TAD fabric that is used in the inventive drying section 2 and the fabric 9 carries the fibrous web W to at least one through air drying cylinder (TAD cylinder). In the embodiment shown in FIG. 1, the drying section 2 comprises a first through air drying cylinder 3 and a second through air drying cylinder 5. While only two TAD cylinders (through air drying cylinders) are shown in FIG. 1, it should be understood that the inventive drying section 2 may comprise more than two TAD cylinders. For example, the inventive drying section 2 may comprise three TAD cylinders or four TAD cylinders or conceivably even more than four TAD cylinders. It should also be understood that embodiments with only one through air drying cylinder are conceivable. Each through air drying cylinder 3, 5 is arranged to be rotatable and the direction of rotation during operation is indicated by the arrows "R". Each of the through air drying cylinders 3, 5 has an outer circumference 4, 6 and the air permeable fabric 9 is arranged to run in a loop that wraps a part of the outer circumference 4, 6 of each through air drying cylinder 3, 5. Each through air drying cylinder 3, 5 has a hood 7, 8 as is known in the art. Each hood 7, 8 covers the part of the outer circumference 4, 6 of each through air drying cylinder 3, 5 about which the fabric 9 is wrapped. The fabric 9 may be, for example, such a fabric as is disclosed in U.S. Pat. No. 7,114,529, 9,422,666 or 5,554,467 but other kinds of TAD fabrics may also be used. The fabric 9 is designed to create a three-dimensional structured pattern in the fibrous web W and the molding box 52 serves to draw the fibrous web W into the fabric 9 such that the fibrous web will get a three-dimensional pattern from the fabric 9. The molding box 52 may be, for example, such a suction device as disclosed in WO 2017/082788 but other kinds of molding boxes may also be used. There may also be a speed difference between the forming fabric 39 and the fabric 9 to further facilitate the creation of the three-dimensional structured pattern.

The fabric 9 is arranged to run in a predetermined direction of movement as indicated by the arrow "A". In doing so, it will carry the fibrous web W over the through air drying cylinders 3, 5 such that the fibrous web is dried. When the fabric 9 has carried the fibrous web W over the through air drying cylinders 3, 5, the fabric transports the fibrous web further to a transfer point 15 where the fibrous web W is transferred to either the smooth outer surface 27 of a Yankee drying cylinder 16 or to another machine component (not shown). In the embodiment of FIG. 1, the Yankee drying cylinder 1 is arranged to be rotatable in the direction of arrow "R". In advantageous embodiments, the Yankee drying cylinder 16 has a Yankee hood 42. The Yankee hood 42 may be, for example, a Yankee hood as disclosed in EP 2963176 B1 but other designs for the Yankee hood are also conceivable. On the Yankee drying cylinder 16, the fibrous web is subjected to further drying. The design of the Yankee drying cylinder may be, for example, as disclosed in EP 2126203 B1 but the Yankee drying cylinder can also be designed in other ways as is known to those skilled in the art of papermaking. The Yankee drying cylinder is preferably heated from inside by hot steam. In the embodiment of FIG. 1, a doctor 40 is arranged to crepe off the ready-dried fibrous web W from the smooth outer surface 27 of the Yankee drying cylinder 16 and the fibrous web W will then travel to a reel-up 35 where the fibrous web will be wound into a roll 42. The transfer from the air permeable fabric 9 to the smooth surface 27 of the Yankee drying cylinder 16 may be achieved in a nip between the Yankee drying cylinder 16 and a roll 43. The reel-up 42 may be, for example, such a reel-up as disclosed in U.S. Pat. No. 5,901,918 but reel-ups using another design may also be used.

Figure 2:
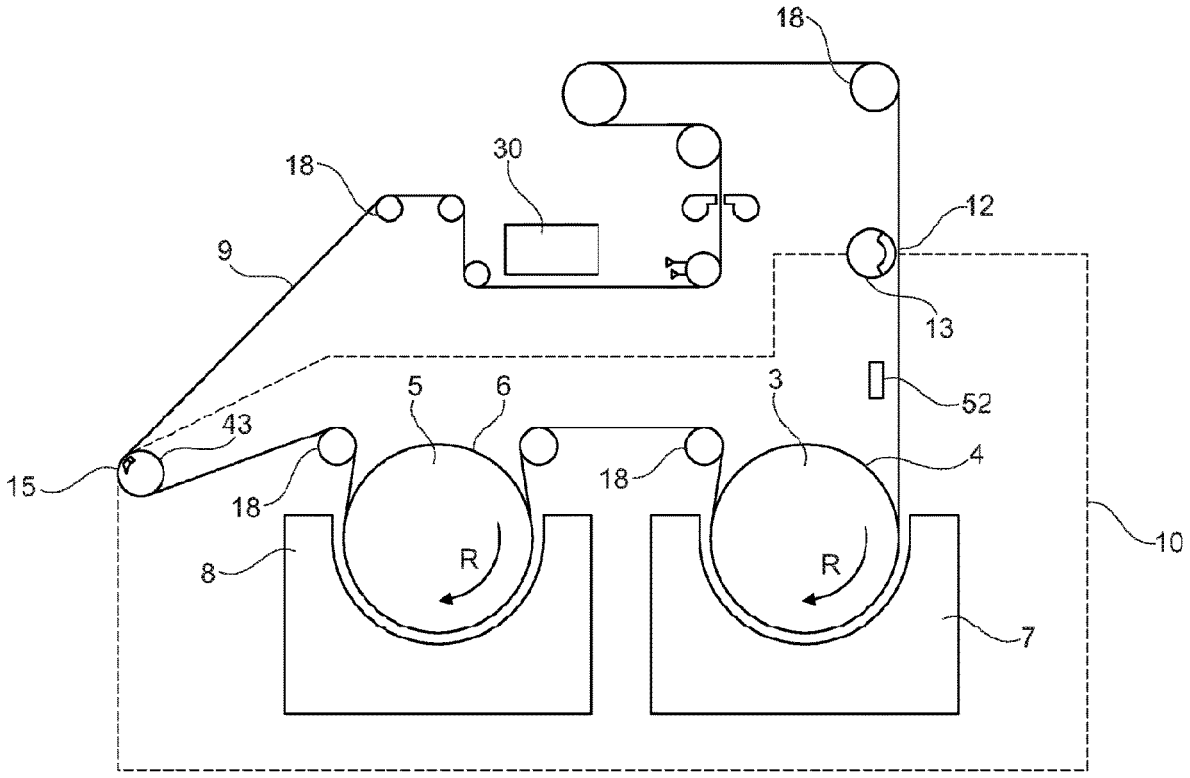
FIG. 2 is a view of the entire drying section which shows a possible general layout of the drying section.
Figure 3:
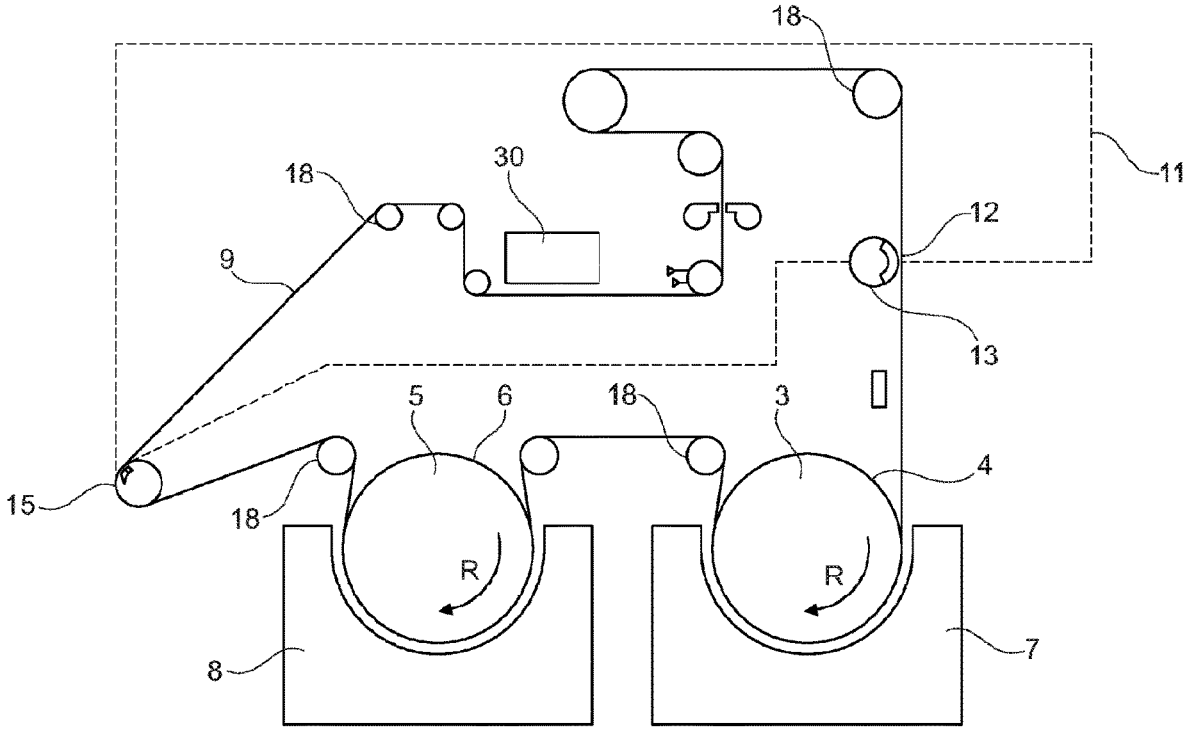
FIG. 3 is a view similar to that of FIG. 2

With reference to FIG. 2 and FIG. 3, the loop of the air permeable fabric 9 is divided into a web-carrying part 10 and a conditioning part 11. In the web-carrying part 10 of the fabric loop, the fabric 9 carries the web W. One side of the fabric 9 is arranged to contact the fibrous web W in the web-carrying part 10 and thus constitutes a web-contacting side of the fabric 9, The web-carrying part 10 extends from the receiving point 12 (pick-up point 12) from a previous section 14 (in the embodiment of FIG. 10, the previous section 14 is the forming section) where the fabric 9 picks up the fibrous web W to the transfer point 15 where the drying section 2 is designed to transfer the fibrous web W from the fabric 9 to a further machine component (in the embodiment of FIG. 1, the further machine component is the Yankee drying cylinder 16). As the fabric 9 carries the fibrous web W in the web-carrying part 10, the fabric 9 inevitably picks residue from the fibres in the fibrous web W and possibly also other contaminants. Fibre residue and other contaminants may clog the fabric. If no action is taken to remove residue (and other contaminants), the permeability of the fabric 9 will be reduced which in turn can interfere with web transfer. Moreover, clogging in the fabric can result in defects in the fibrous web. Therefore, it is desirable to remove contaminants from the fabric 9 and this is done in the conditioning section 11. Along the run of the loop formed by the fabric 9, the conditioning section 11 extends, in the predetermined direction of movement of the fabric 9, from the transfer point 15 to the receiving point 12 where the suction device 13 inside the loop of the fabric 9 is arranged to pick up the still wet fibrous web W from the previous section 14. It should be noted that conditioning of the fabric 9 is normally not carried out all the way up to the receiving point 12. However, in the context of this patent application, the conditioning part 11 of the fabric loop is defined as the part of the fabric loop that extends from the transfer point 15 to the receiving point 12.

Figure 4:
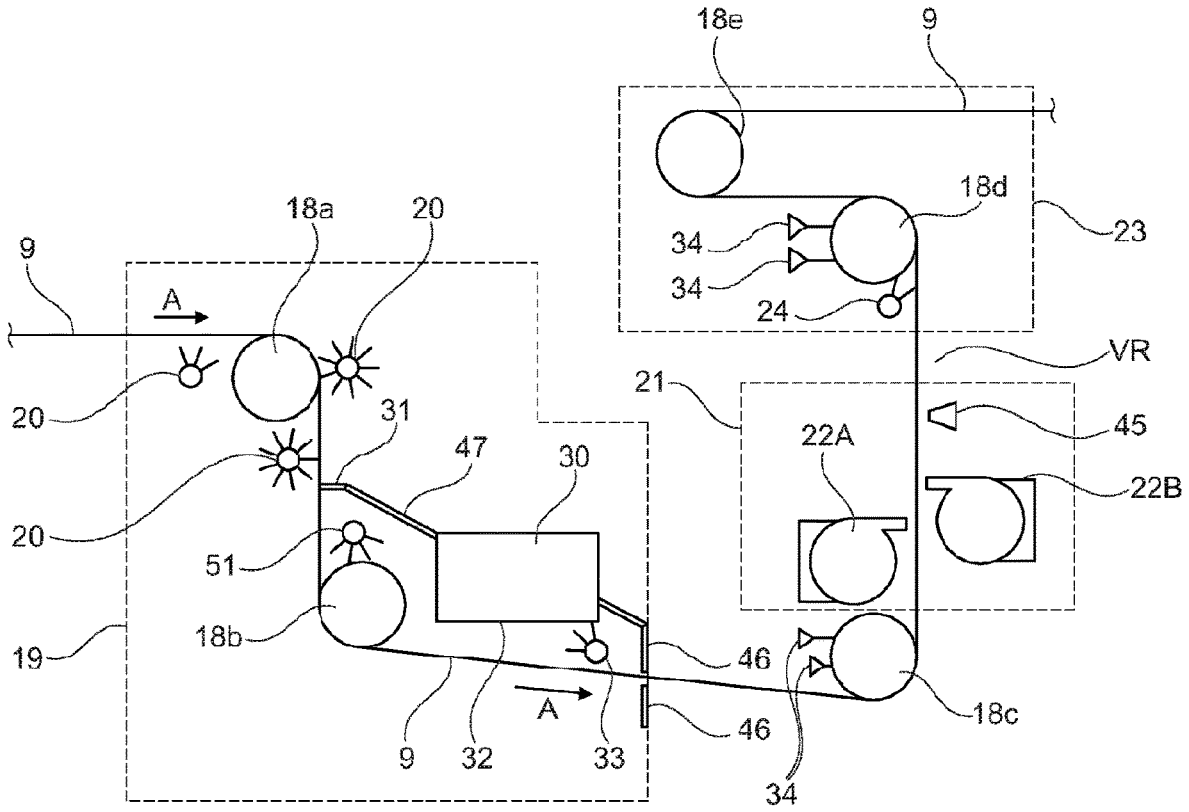
FIG. 4 shows in greater detail a part of the drying section shown in FIG. 2.

With reference to FIG. 4, the conditioning section 11 has a cleaning section 19 that comprises at least one shower 20 arranged to act on the fabric 9 in the conditioning part 11 of the fabric loop. The function of the shower or showers 20 is to wash away contaminants such as fibre residue from the fabric 9. In the embodiment shown in FIG. 4, three showers 20 are shown as being arranged to act against the fabric 9 but it should be understood that also embodiments with two showers 20 are possible and embodiments with more than two showers 20, for example embodiments with three, four, five or six showers 20 or even more than six showers 20. When more than one shower 20 is used, it is preferred that at least one shower 20 is arranged on each side of the fabric 9. If only one shower 20 is used, this shower 20 should preferably be arranged to act against that side of the fabric 9 that has faced the fibrous web W and come into direct contact with the fibrous web W. At the end of the cleaning section, a pair of seals 46 are arranged on opposite sides of the fabric 9 and opposite each other. In this context, it should be understood that the expression "opposite each other" does not necessarily mean that the seals 46 are placed exactly opposite each other since such a positioning could entail a risk that the seals 46 would pinch the fabric. To avoid the risk of pinching, the seals 46 may instead be placed such that there is a small offset in the machine direction between them. The seals 46 define the end of the cleaning section. In practice, the seals 46 may be, for example, a pair of foils made of a ceramic, plastic or metallic material. Conceivably, the seals 46 could also be rubber wipers. A blade or foil 31 (for example a ceramic, plastic or metallic blade) may optionally be arranged to wipe off water from the fabric and guide water into a pan 30 over a guide 47. This blade 31 is placed in a position upstream (upstream in the direction of movement of the fabric 9) of the seals 46 that define the end of the cleaning section 19. The blade 31 has the effect that less water will pass into the nip between the fabric and the lower turning roll 18 (see FIG. 4). This blade can also act to prevent contaminants freed by previous showers from being pressed back into the fabric 9 at the ingoing nip formed between the fabric 9 and the rotating roll 18*b*. A guide surface formed by an element 47 such as a piece of sheet metal forms a guide path for water such that water wiped off from the fabric 9 by the blade 31 can flow into a pan 30 that may suitably be arranged in the cleaning section.

After cleaning, the fabric 9 will have a substantial amount of water in it and dewatering is required to reduce energy consumption and to create optimum conditions for the application of a release agent and to aid with web transfer. Therefore, the conditioning section 11 also comprises a dewatering section 21 that is arranged to act on the fabric 9 in the conditioning part 11 of the fabric loop in order to dewater the fabric 9 in an area that lies after the cleaning section 19 in the predetermined direction of movement of the fabric 9. The dewatering section 21 comprises one or several suction dewatering devices 22, 22A, 22B. The suction dewatering device(s) 22 dewater the fabric by means of suction. In the embodiment of FIG. 4, the dewatering section 21 has two suction dewatering devices 22A and 22B, one on each side of the fabric 9 but it should be understood that more than one suction dewatering device 22A, 22B may be used. In FIG. 4, the suction dewatering device 22A is placed on the web-contacting side of the fabric 9 and the suction dewatering device 22B is placed on the side of the fabric 9 that does not contact the web W (when only the reference numeral 22 is used, it refers to any suction dewatering device in the dewatering section). For example, there could be three, four, five or six such suction dewatering devices 22. Embodiments having only one such suction dewatering device 22 are also possible. When more than one suction dewatering device 22 is used, there should preferably be at least one suction dewatering device 22 on each side of the fabric 9.

In an area that lies after the dewatering section 21 in the predetermined direction of movement of the fabric 9, an applicator section 23 is arranged in the conditioning part 11 of the fabric loop. The applicator section 23 comprises at least one applicator 24 that is arranged to apply a release agent on the fabric 9 for facilitating release of a fibrous web W from the fabric 9 at a later stage after the fibrous web W has been dried on the through air drying cylinder(s) 3, 5, in particular to facilitate release of the fibrous web W from the fabric 9 at the transfer point 15. The release agent may be, for example, a vegetable oil, a mineral oil or comprise vegetable and/or mineral oil.

According to the invention, the dewatering part of the fabric loop 9 comprises a substantially vertical run VR of the fabric 9 (see FIG. 4) and at least one suction dewatering device 22A is placed along the vertical run VR of the fabric 9 and located on the web-contacting side of the fabric 9 such that it can perform dewatering on the web-contacting side of the fabric 9. Furthermore, the dewatering section 21 is designed such that it either comprises a further suction dewatering device 22B that is placed along the vertical run VR of the fabric 9 on the side of the fabric 9 that is opposite the web-contacting side or that that the dewatering section 21 has room for installing (along the vertical run VR on the side opposite the web-contacting side of the fabric 9) a further suction dewatering device 22B of at least the same size as the suction dewatering device 22A that is located on the web-contacting side of the fabric 9. The predetermined direction of movement of the fabric 9 in the vertical run VR of the fabric loop along which the at least one suction dewatering device 22A is placed is an upward direction.

By placing the at least one suction dewatering device 22A along a vertical run VR, the advantage is attained that any water that leaves the fabric 9 as water mist or droplets but which is not sucked into any of the suction dewatering devices 22 will tend to fall downwards instead of instead of going in the direction in which the fabric 9 is moving. In the context of this patent application, the term "substantially vertical" should be understood as meaning that the fabric run VR does not deviate more than 30° from a perfectly vertical plane, preferably not more than 20° from a perfectly vertical plane and even more preferred not more than 10°. Ideally, the vertical run VR should be perfectly vertical and thus form an angle of 90° to the horizontal plane. However, already inevitable imperfections in the manufacturing process and during the process of assembly may result in small deviations of one to four degrees. Already for this reason, the expression "substantially vertical" must be understood as including some angles having a small deviation from a perfectly vertical plane. Moreover, limitations on available space can sometimes make it necessary to deviate even more from a perfectly vertical plane. Deviations up to 10° are deemed by the inventors to have only a small detrimental effect while deviations larger than 30° are deemed totally unacceptable.

When the suction dewatering box 22A is placed such that it can act on the web-contacting side of the fabric 9, this entails the advantage that the advantage that rewetting of the fibrous web can be minimized when the fabric 9 contacts the fibrous web again. Since rewetting will be affected more by water remaining on the web-contacting side of the fabric 9, it is especially important that dewatering is achieved on that side of the fabric 9.

If two suction dewatering devices 22 are placed along the vertical run VR on opposite sides of the fabric 9, the advantage is attained that dewatering can be achieved with the same efficiency on both sides of the fabric 9.

If only one suction dewatering box 22A is used in the dewatering section but the dewatering section has room for at least one additional suction dewatering box 22B on the opposite side of the fabric 9, this entails the advantage that flexibility is achieved. If it is later found that more dewatering is required, an additional suction dewatering box 22B can be added. Alternatively, other equipment can be added such as one or several sensors and/or one or several air knives.

Figure 5:
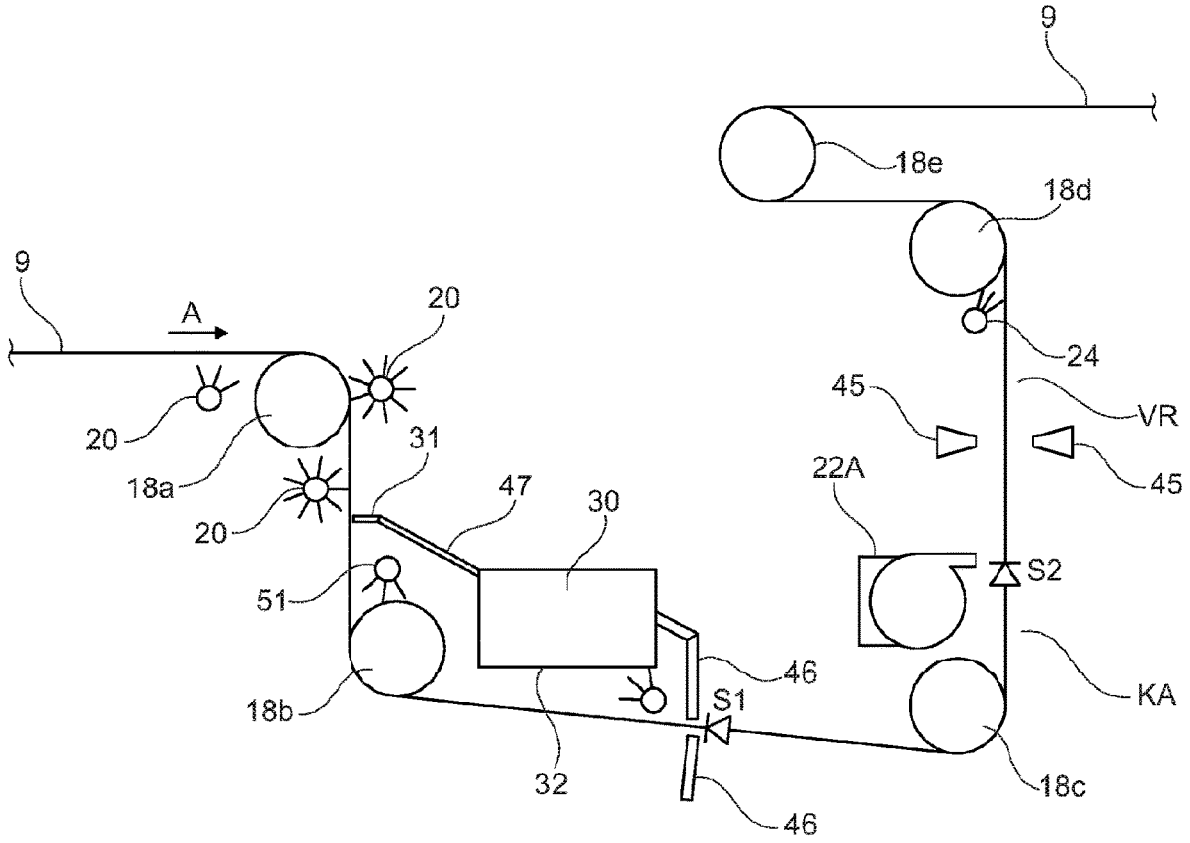
FIG. 5 is a view similar to FIG. 4 but highlighting another feature of the invention.

An air knife 45 may advantageously be arranged to act against the fabric. The air knife (if one is used) can be placed in the dewatering section, for example after the last suction dewatering device 22, i.e. downstream of that suction dewatering device 22 in the predetermined direction of movement of the fabric 9. In the embodiment shown in FIG. 4, the air knife 45 is placed on the side of the fabric 9 that is opposite the web-contacting side of the fabric. As shown in FIG. 5, an air knife 45 may also be placed on that side of the fabric 9 that meets the fibrous web in the web-carrying part of the fabric loop.

One feature which may optionally be included in some embodiments of the invention will now be explained with reference to FIG. 5. In FIG. 5, some of the components of FIG. 4 are not shown since FIG. 5 serves to explain a separate feature of the invention. The inventors of the present invention have found that, if the cleaning and dewatering sections are not sufficiently separated from each other, this may sometimes have the consequence that water from the showers tends to carry along the fabric and bypass the dewatering equipment. This is undesirable since rewetting will occur with adverse effects to the subsequent transfer, molding and drying processes. While this deficiency may be less serious for slow speed machines, it can potentially become more serious for modern high-speed TAD machines that can operate at speeds of 1200 m/min or higher. Today (2018), new TAD machines are normally designed for speeds of about 1600 m/min but there is a general trend toward higher speeds and speeds of up to 2000 m/min for TAD machines or even higher are conceivable and manufacturers of TAD machines need to consider what this may mean for the requirements of different machine sections. If the distance that separates the cleaning section from the dewatering section is increased, there will be more time for water to fall off from the fabric 9 such that the fabric 9 will carry less water when it reaches the first suction dewatering device 22 in the dewatering section. The inventors have found that the risk of water being carried along and bypassing the dewatering equipment can be reduced if the shortest distance in the predetermined direction of movement of the fabric 9 between the end of the cleaning section 19 at the pair of seals 46 and a suction dewatering device 22 in the dewatering section 21 is selected to allow more water to fall off. With reference to FIG. 5, the reference KA is used for the distance along the run of the fabric that extends from the point $S_1$ to the point $S_2$, i.e. the shortest distance along the run of the fabric 9 between the end of the cleaning section 19 and a suction dewatering device 22 in the dewatering section. This can also be expressed in terms of the distance KA being the distance from the end of the cleaning section at the pair of seals 46 that define the end of the cleaning section 19 to the first suction dewatering device 22 in the dewatering section. The inventors have found that it is advantageous to select this distance such that it lies in the range of 2.5 m-6 m, (i.e. the distance KA from the pair of seals 46 to the first suction dewatering device 22 lies in that range). The distance 2.5 m is regarded as a lower limit for machine speeds of 1500 m/min while a larger distance may be desirable at higher speeds. At a machine speed of 2000 m/min, the shortest distance KA may be selected to be 3.5 m and could well be 5 m. For most practical applications with current machine speeds, it is deemed that a shortest distance KA may be in the range of 3 m-5 m. For machine speeds exceeding 2000 m/min, for example up to 2200 m/min, it may be suitable to use a shortest distance KA which is up to 6 m. However, due to the limitations imposed by available space, a distance exceeding 6 m is deemed impractical in most realistic cases. By selecting the shortest distance KA in the range of 2.5 m-6 m, the amount of water that is carried along by the fabric 9 to the dewatering equipment can be reduced such that the risk of disturbances to the subsequent transfer, molding and drying processes are correspondingly reduced. While such a selection of the shortest distance KA can thus be advantageous, it should be understood that this selection is an optional feature and that embodiments of the invention are possible in which the shortest distance KA lies outside the range of 2.5 m-6 m. Embodiments of the invention are thus conceivable in which the distance KA is significantly smaller than 2.5 m. For example, the shortest distance KA may be only 1 m or even less than 1 m. Likewise, embodiments are conceivable in which the shortest distance KA is larger than 6 m. For example, it could be as large as 8 m or even more than 8 m. As previously mentioned, there may be a small offset between the seals 46. For clarity, it may be mentioned that for cases where there is an offset between the seals 46, the point S1 is defined by that seal 46 which, in the direction of movement of the fabric 9, is closest to the first suction dewatering device 22 in the dewatering section.

Figure 6:
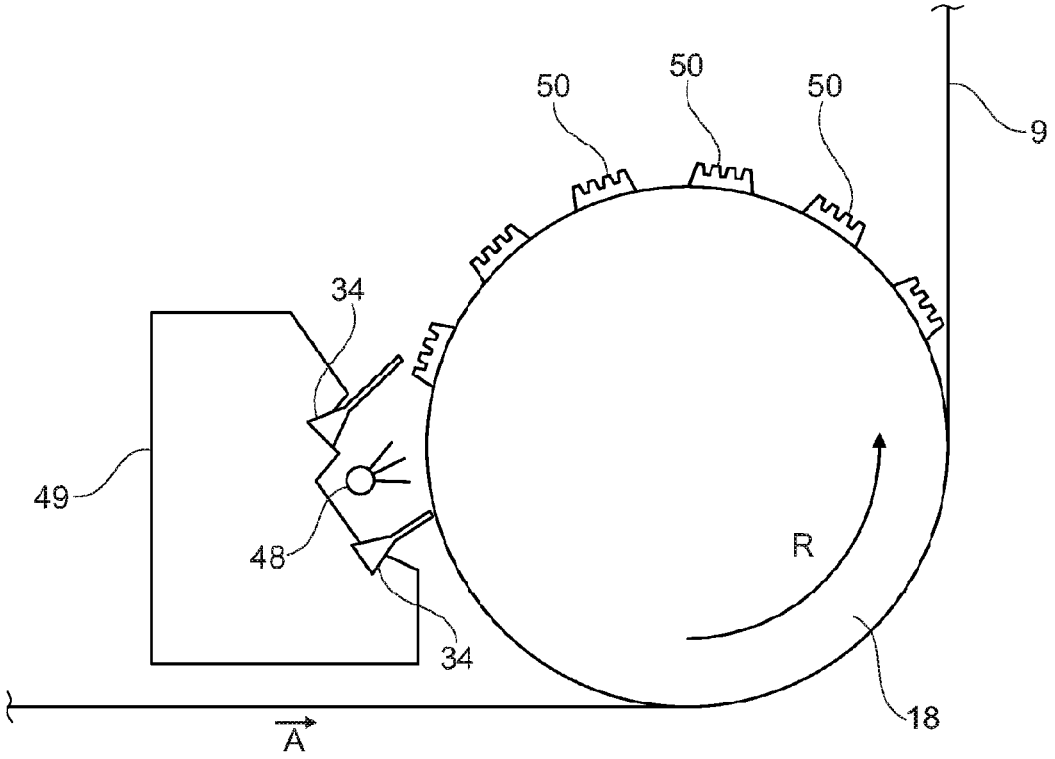
FIG. 6 shows a detail of the part shown in FIG. 4.

Reference will now be made to FIG. 4 and to FIG. 6. In embodiments in which at least a part of the dewatering section 21 is located in a vertical run VR in which the predetermined direction of movement of the fabric 9 is an upward direction, it is preferable that the fabric 9 wraps a lead roll 18*c* at the beginning of the part of the fabric loop where the fabric 9 extends vertically. That roll 18*c* will then serve as a lower turning roll around which the fabric 9 changes its direction of movement to an upward direction (see FIG. 4 and FIG. 6). Preferably, two doctors 34 are arranged to act on that lead roll 18*c* to remove contaminants such as fibre residue from the lead roll 18. With continued reference to FIG. 6, contaminants tend to get stuck on the surface of the lead roll 18*c* and may form lumps 50 as indicated in FIG. 6. Contaminants (e.g. fibres) within the structure of the fabric 9 is detrimental to drying uniformity (In the machine direction MD and in the cross-machine direction CD) as well as overall TAD energy use. For the TAD (through air drying) fabric to function properly, it must have a high and uniform air permeability, hence the requirement for thorough cleaning of the web. Larger pieces of contaminants—lumps—embedded or pressed into the TAD fabric will impede drying in this localized area and create a weak spot. Even with a properly functioning system of showers 20 and suction dewatering devices 22, there are still contaminants such as residual fibre on and within the TAD fabric 9. These contaminants will transfer to any sheet side and non-sheet side and rolls that the fabric 9 contacts after having left the cleaning section. These contaminants must be removed from the rolls, otherwise the contaminants will build up to create larger lumps and be pressed or "ironed" back into the TAD fabric. The inventors have found from practical experience that, if the contaminants are pressed back into the TAD fabric, this will create a "contaminated" spot on the fabric 9 (the TAD fabric) which can interfere with sheet transfer. Furthermore, this area is much less permeable to air and air permeability of the fabric 9 is required at the suction device 13 and the molding box 52. Air permeability is also required when the fabric 9 passes over through air drying cylinders 3, 5. Those parts of the fibrous web W that come into contact with contaminated spots of the fabric 9 will not dry properly compared to the rest of the fibrous web thus creating wet spots that may create holes or other defects in the ready-dried paper product.

The inventors have found that the technical problem of contaminants on the lower turning roll can be counteracted by the use of double doctor blades on the sheet side and possibly non-sheet side rolls after the cleaning section. Possibly, double doctors can also be used on non-sheet side rolls. The double doctor blades will ensure the roll 18*c* is doctored twice every revolution so that any contaminants that might get past the doctor blade of the first doctor 34 will be captured and doctored by the second doctor blade. Therefore, the roll coming back to meet the fabric 9 will be contaminate free which will minimize if not eliminate the possibility of any contaminants (for example fibre or fibre lumps) from being pressed or "ironed" back into the air permeable fabric 9 creating a wet spot and hole in the paper. Therefore, in order to remove contaminants such as fibre residue from the roll 18 that serves as a lower turning roll before the suction dewatering device(s) in the dewatering section 21, the inventors have found that two doctor blades 34 should be arranged to act against that roll to scrape off contaminants from the surface of the roll. The inventors have found that just one doctor blade 34 is insufficient and that contaminants may pass such a single doctor blade 34 and be pressed into the fabric 9.

To minimize the risk of roll wear from the application of double doctoring and to assist in removing contaminants (for example fibre residue), it might be necessary to apply a low pressure, low volume misting shower between the doctor blades to gently lubricate the roll and contaminants. As can be seen in FIG. 6, a misting shower 48 may advantageously (but not necessarily) be arranged between the two doctors 34 to minimize roll wear and assist in removing fibre and other contaminants.

The same arrangement with two doctors 34 can be used also on the lead roll 18*d* at the end of that part VR of the fabric loop where the fabric 9 extends vertically and those two doctors can act against the lead roll 18*d* to remove contaminants from the lead roll 18*d* and a misting shower 48 may advantageously (but not necessarily) be placed between those doctors 34.

Preferably, at least a part of the cleaning section 19 is arranged in a part of the fabric loop in which the predetermined direction of the fabric 9 is a downward direction. This entails the advantage that that it becomes easier to arrange at least a part of the dewatering section 21 in an upward run without unduly increasing the overall height of the entire conditioning part 11.

Figure 7:
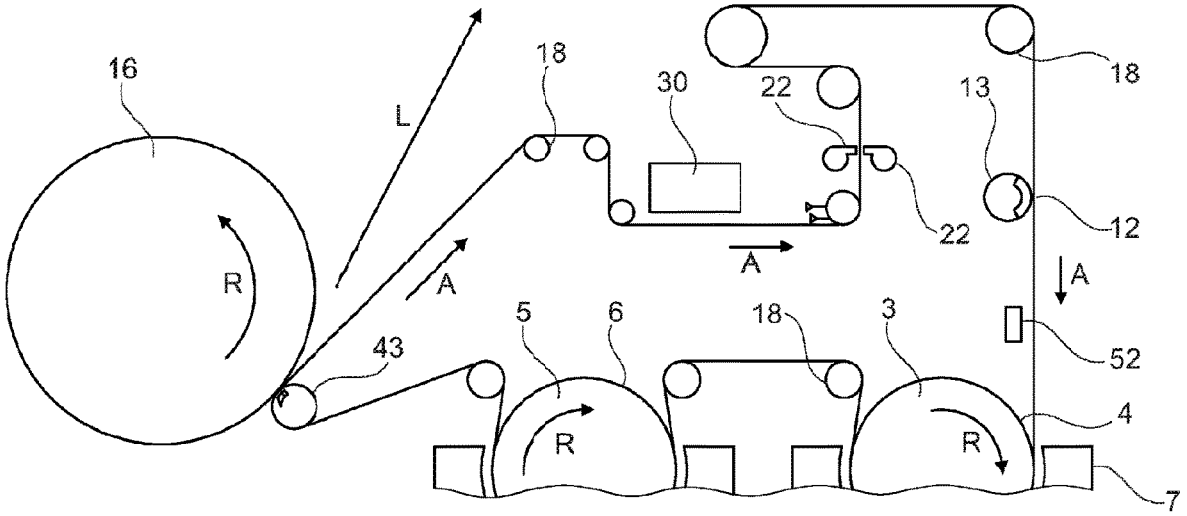
FIG. 7 is a view substantially similar to FIG. 1 but illustrating a technical problem related to the operation of the drying section.
Figure 8:
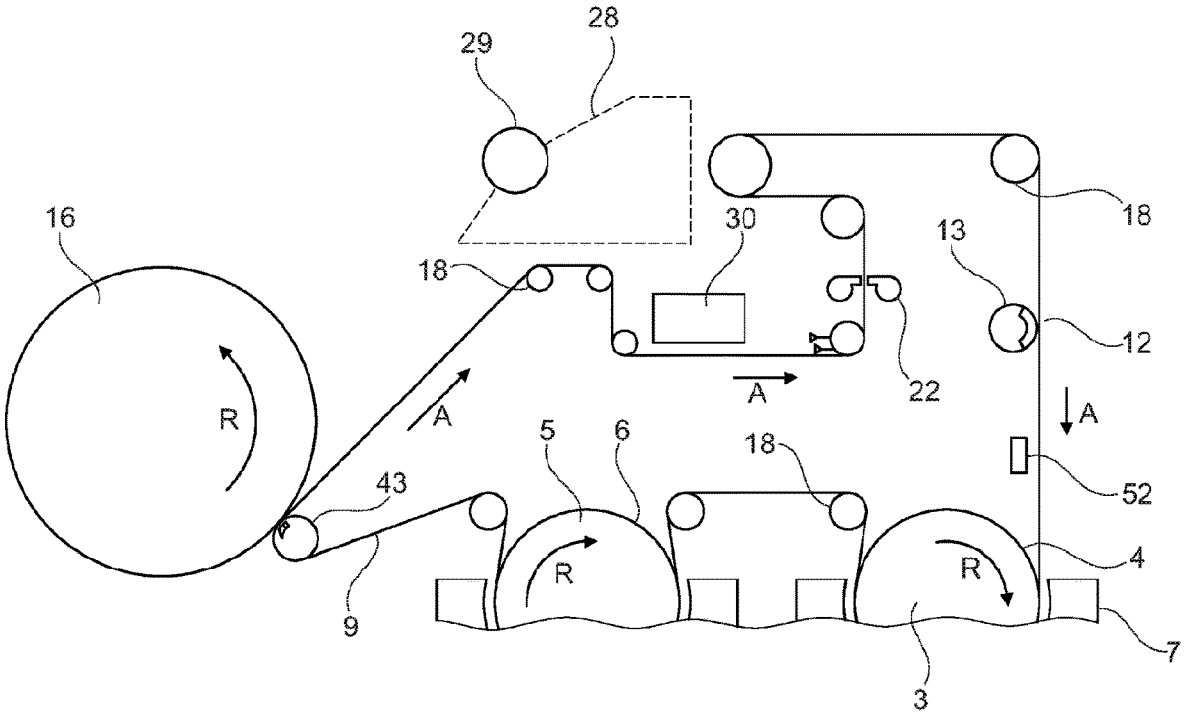
FIG. 8 is a view similar to that of FIG. 7 but illustrating the solution to the technical problem explained with reference to FIG. 7.
Figure 9:
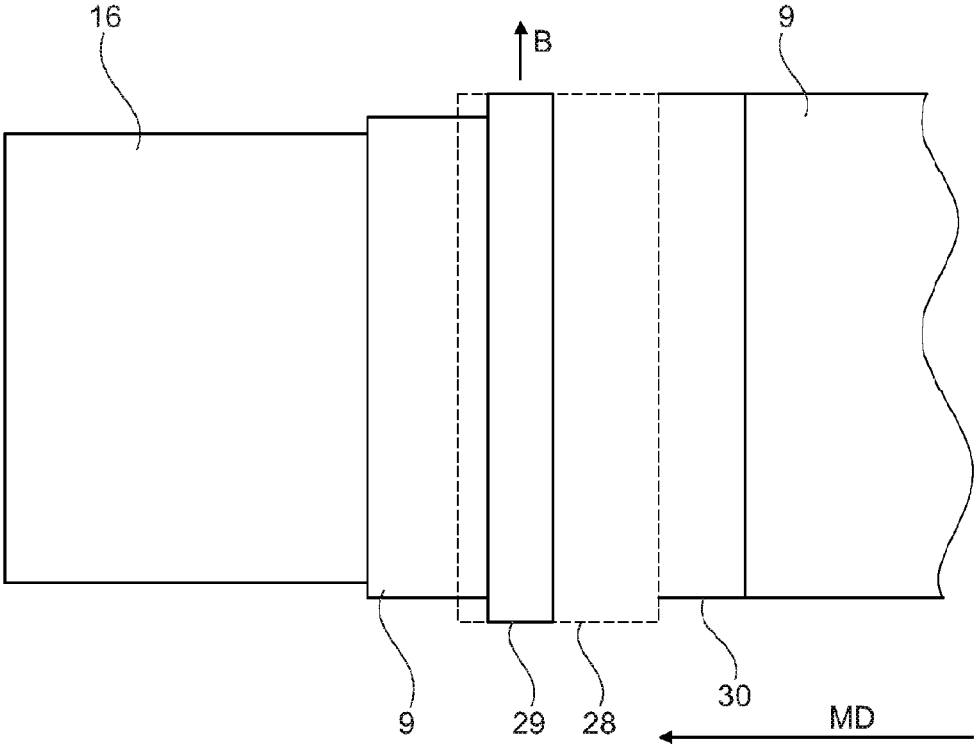
FIG. 9 shows the same solution as illustrated in FIG. 8 but as seen from above.

Another feature of the inventive drying section which may advantageously be included in such embodiments of the invention that use a Yankee drying cylinder 16 with a smooth outer surface 27 will now be explained with reference to FIG. 7, FIG. 8 and FIG. 9. The inventors have found that the rotation of the Yankee drying cylinder 16 (indicated by arrow R) and the movement of the fabric 9 (indicated by arrow A) will cooperate to generate a stream of air in the direction of arrow L, i.e. upward and against the machine direction MD, see FIG. 7. Moreover, the inventors have found that this stream of air is likely to carry fibre particles that may subsequently fall down on the forming and drying sections. In preferred embodiments of the invention, the conditioning part 11 of the loop of the air permeable fabric 9 is located vertically above the web-carrying part 10. Fibre particles entrained by the air stream L which is generated by the movement of the Yankee drying cylinder 16 and the fabric 9 will then fall predominantly on the conditioning part 11. If fibre particles should fall on the conditioning part 11, this will counteract the cleaning which is performed and is thus highly undesirable. With reference to FIG. 8 and to FIG. 9, a suction and blowing device 29 may be placed above a part of the conditioning part 11 of the fabric loop located adjacent the Yankee drying cylinder, i.e. in the area which will be reached by the air stream L generated by the fabric 9 and the Yankee drying cylinder 16. The suction and blowing device 29 is arranged suck in air and blow the air away from the area above the conditioning part 11 of the fabric loop. Preferably, the air is blown away from the suction/blowing device 29 in a direction indicated by arrow B in FIG. 9, i.e. in the Cross Direction (CD) which is horizontal and perpendicular to the machine direction MD. Here, it should be understood that the machine direction MD is defined as the direction in which the drying section 2 is arranged to carry the fibrous web W through itself. The idea of using a suction/blowing device 29 cooperates with the other features of the inventive drying section to improve conditioning of the fabric 9 but may also be used independently of how the conditioning part of the fabric loop is otherwise designed.

Optionally, a hood 28 may be placed over at least a part of the conditioning part 11 of the fabric loop to prevent fibre residue to fall on the conditioning part 11, preferably the hood 28 should cover a part of the fabric 9 that lies in the area above that TAD cylinder that is closest to the Yankee drying cylinder 16. Instead of falling directly on the conditioning part 11, fibre residue will land on top of the hood 28, i.e. on the roof of the hood 28. In embodiments of the invention, the entire conditioning part 11 may be covered by such a hood 28. If both a suction/blowing device 29 and a hood 28 are used, the suction/blowing device 29 may be integrated with the hood 28.

With reference to FIG. 4 and FIG. 5, the cleaning section includes a vertical or substantially vertical run between an upper lead roll 18*a* and a lower lead roll 18*b* which upper and lower lead rolls 18*a*, 18*b* serve as turning rolls where the fabric 9 changes its course. A shower 51 may be arranged to act on the lower lead roll 18*b* (turning roll 18*b*) in the cleaning section to wash away fibre residue from that roll. Prior to the dewatering section 21, the fabric changes its direction of movement around a lower lead roll 18*c* (turning roll 18*c*) after which the fabric 9 runs along the upward vertical run VR. Between the lower lead rolls 18*a*, 18*c*, the fabric 9 follows a run which is horizontal or deviates from the horizontal plane by preferably not more than 15° and even more preferred by not more than 5° and the last part of the cleaning section with the seals 46 is located on that substantially horizontal run between the lower lead rolls. In preferred embodiments, a pan 30 may be arranged above the substantially horizontal fabric run that extends between the lower lead rolls 18*b*, 18*c* and a blade 31 which is arranged in the vertical run between the upper and lower lead rolls 18*a*, 18*b* is arranged to act against the fabric 9 to wipe off water from the fabric 9 and guide water that has been wiped from the fabric 9 into the pan 30. In preferred embodiments, the pan 30 has a bottom wall 32 that faces the fabric 9 and at least one shower 33 is arranged to wash away fibre residue from the bottom wall 32. Embodiments are conceivable in which only one such shower 33 is used but embodiments using two, three or more than three showers are also conceivable. The at least one shower 33 that is arranged to act against the bottom wall 32 prevents or reduces the risk that fibre particles build up to form great lumps on the bottom wall 32. If great lumps of fibre build up on the bottom wall 32, such lumps will eventually fall onto the fabric 9 where they may cause problems, for example at the next lead roll 18*c*. While the upper seal 46 at the end of the cleaning section may wipe off such lumps, that could lead to a build-up of lumps at the seal 46 which would also be undesirable. When the shower 33 acts on the bottom wall 32, the fibres can be washed off continuously or intermittently before they have formed lumps. Preferably, the fibres are washed off intermittently from the bottom wall 32 by the shower 33. It should be understood that more than one shower 33 may be arranged to act against the bottom wall 32. For example, there may be two showers 33, three showers 33 or more than three showers 33. Each part of the fabric 9 will receive only a small amount of fibre residue from the bottom wall 32 and such fibre residue can be more easily dealt with at following stations.

Figure 10:
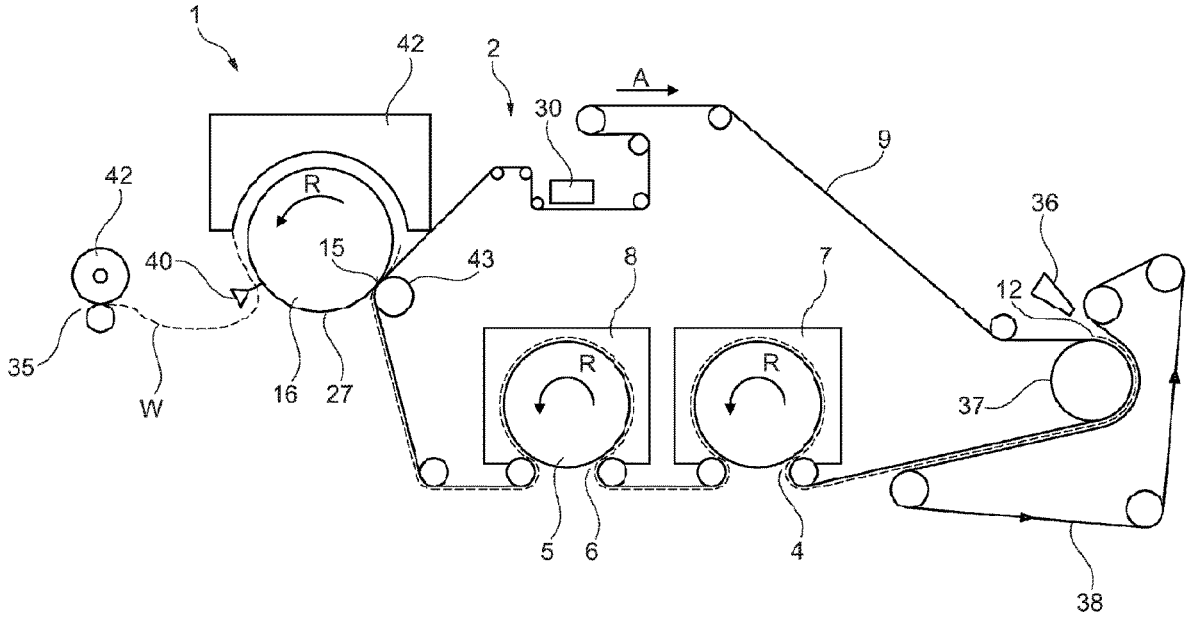
FIG. 10 is a figure similar to FIG. 1 but showing an alternative layout in which the inventive drying section may also be used.

In the embodiments described with reference to FIG. 1-FIG. 8, the fibrous web W is picked up by the fabric 9 from a fabric 39 that belongs to a preceding machine section 14 such as the forming section and the fabric 39 may be one of the forming fabrics or it may be a fabric that as received the fibrous web from one of the forming fabrics. An alternative embodiment in which the inventive drying section may also be used will now be described with reference to FIG. 10. In the embodiment of FIG. 10, the fabric 9 does not receive the fibrous web W from one of the forming fabrics (as shown in FIG. 1). Instead, the fabric 9 is itself used as a forming fabric and wraps the forming roll 37. In this embodiment, the receiving point 12 is the point where the fabric 9 meets the forming fabric 38 to cooperate with the forming fabric 38 to form an embryonic web W. Due to the different configuration of the paper making machine 1, the direction of rotation R of the through air drying cylinders 3, 5 is counterclockwise, i.e. opposite the direction of rotation R that is shown in the embodiment of FIG. 1. With regard to the arrangement and operation of the conditioning part 11 of the loop of the fabric 9, the embodiment of FIG. 10 functions in the same way as the embodiment described with reference to FIG. 1-FIG. 8 and FIG. 9. In this context, it should be understood that the TAD section with the through air drying cylinders 3, 5 may have many different configurations and the configurations shown in FIG. 1 and FIG. 10 are only examples of possible configurations. For example, the TAD section could be designed such that it comprises only one through air drying cylinder which may optionally be combined with a Yankee drying cylinder that follows the through air drying cylinder. Each through air drying cylinder and its associated hood 7, 8 may be designed for blowing air from the hood and into the through air drying cylinder or for blowing air from the inside of the through air drying cylinder into the associated hood 7,8.

The inventive way of conditioning the fabric 9 may conceivably also be used in other kinds of paper making machines than machines using through air drying cylinders. For example, the inventive way of conditioning the fabric may be used for a machine in which a structured fabric 9 as described previously is used in a press nip in which a three-dimensional pattern is created in a fibrous web when a patterned side of the fabric contacts the fibrous web in a press nip whereafter the fibrous web is carried by the structured/textured fabric 9 to a Yankee drying cylinder where the fibrous web is transferred from the structured/textured fabric 9 to the surface of the Yankee drying cylinder. After the structured/textured fabric has delivered the fibrous web to the Yankee drying cylinder, the structured/textured fabric may need conditioning which may be carried out in a conditioning section as described in this patent application.

The invention claimed is:

1. A drying section (2) of a paper making machine (1) which drying section is designed to perform drying of a fibrous web (W) and which drying section (2) comprises:

one or more through air drying cylinders (3, 5) each of which has an outer circumference (4, 6) and which through air drying cylinder(s) (3, 5) is/are arranged to be rotatable;

a fabric (9) that is permeable to air and arranged to run in a loop and which wraps a part of the outer circumference (4, 6) of each through air drying cylinder (3, 5), the fabric (9) further being arranged to run in a predetermined direction of movement and the loop of the fabric (9) being divided in a web-carrying part (10) in which the fabric (9) carries the fibrous web (W) and wraps the through air cylinder(s) (3, 5) and a conditioning part (11), one side of the fabric (9) being arranged to contact the fibrous web (W) in the web-carrying part (10) and thus constitute a web-contacting side of the fabric (9), the web-carrying part (10) extending from a receiving point (12) which is either a pick-up point where a suction device (13) inside the loop of the fabric (9) is arranged to pick up a still wet fibrous web (W) from a previous section (14) or a point on the fabric (9) where the fabric (9) comes into contact with a fiber slurry which is used to form the fibrous web (W) if the fabric (9) also serves as a forming fabric, and from the receiving point (12) to a transfer point (15) where the drying section (2) is designed to transfer the fibrous web (W) from the fabric (9) to a further machine component, the conditioning part (11) of the fabric loop extending in the predetermined direction of movement of the fabric (9) from the transfer point (15) to the receiving point (12);

a hood (7, 8) that covers the part of the outer circumference (4, 6) of each through air drying cylinder (3, 5) about which the fabric (9) is wrapped;

a plurality of lead rolls (18) supporting the fabric in its loop;

a cleaning section (19) comprising at least one shower (20) arranged to act on the fabric (9) in the conditioning part (11) of the fabric loop to wash away residue from the fabric (9);

a dewatering section (21) that is arranged to act on the fabric (9) in the conditioning part (11) of the fabric loop to dewater the fabric (9) in an area that lies after the cleaning section (19) in the predetermined direction of movement of the fabric (9), the dewatering section (21) comprising one or several suction dewatering devices (22, 22A, 22B);

an applicator section (23) that is arranged in the conditioning part (11) of the fabric loop in an area that lies after the dewatering section (21) in the predetermined direction of movement of the fabric (9), the applicator section (23) comprising at least one applicator (24) arranged to apply a release agent on the fabric (9) for facilitating release of a fibrous web (W) from the fabric (9) at a later stage after the fibrous web (W) has been dried on said one or more through air drying cylinders (3, 5), wherein:

the dewatering section (21) of the fabric loop comprises a substantially vertical run (VR) of the fabric (9) which substantially vertical run (VR) does not deviate more than 30° from a perfectly vertical plane, at least one suction dewatering device (22A) is placed along the vertical run (VR) of the fabric (9) and located on the web-contacting side of the fabric (9) such that it can perform dewatering on the web-contacting side of the fabric (9), the dewatering section (21) either comprises a further suction dewatering device (22B) placed along the vertical run (VR) of the fabric (9) on the side of the fabric (9) that is opposite the web-contacting side or that that the dewatering section (21) has room on the side opposite the web-contacting side of the fabric (9) for installing a further suction dewatering device (22B) of at least the same size as the at least one suction dewatering device (22A) that is located on the web-contacting side of the fabric (9), and the predetermined direction of movement of the fabric (9) in the substantially vertical run (VR) of the fabric loop along which the at least one suction dewatering device (22A) is placed is an upward direction.

2. A drying section according to claim 1, wherein at least two suction dewatering devices (22A, 22B) are placed along the vertical run (VR) of the fabric (9) and on opposite sides of the fabric (9) such that they can perform dewatering on both sides of the fabric (9).

3. A drying section (2) according to claim 1, wherein a pair of seals (46) is located opposite each other on each side of the fabric (9), the pair of seals (46) being located at the end of the cleaning section (19) and defines the end of the cleaning section (19).

4. A drying section according to claim 3, wherein the shortest distance in the predetermined direction of movement of the fabric (9) between the pair of seals (46) that defines the end of the cleaning section (19) and a suction dewatering device (22) in the dewatering section (21) lies in the range of 2.5 m-6 m.

5. A drying section according to claim 4, wherein the shortest distance is in the range of 3 m-5 m.

6. A drying section (2) according to claim 1, wherein at least a part of the cleaning section (19) is arranged in a part of the fabric loop in which the predetermined direction of movement of the fabric (9) is a downward direction.

7. A drying section (2) according to claim 6, wherein:

the last part of the cleaning section (19) is located on a part of the fabric run of the fabric (9) which part of the fabric run is substantially horizontal which substantially horizontal part of the fabric run is either horizontal or does not deviate from a horizontal plane by more than 15° and extends between two lead rolls (18*b*, 18*c*), the pair of seals (46) that defines the end of the cleaning section (19) is located at a point of the part of the fabric run that is substantially horizontal and extends between two lead rolls (18*b*, 18*c*), and a pan (30) is arranged above part of the fabric run that is substantially horizontal and extends between two lead rolls (18*b*, 18*c*).

8. A drying section (2) according to claim 7, wherein the pan (30) has a bottom wall (32) that faces the fabric (9) and at least one shower (33) is arranged to wash away fibre residue from the bottom wall (32).

9. A drying section (2) according to claim 1, wherein:

the fabric (9) wraps a lead roll (18) at the beginning of the part of the fabric loop where the fabric (9) extends vertically, two doctors (34) are arranged to act on that lead roll (18*c*) to remove fibre residue from the lead roll (18), and a misting shower (48) is arranged between the two doctors (34).

10. A drying section (2) according to claim 9, wherein:

an initial part of the cleaning section is located on a part of the fabric run that is vertical and precedes the substantially horizontal part of the fabric run above which the pan (30) is arranged, and a blade (31) is arranged in the vertical part of the fabric run that precedes the substantially horizontal part of the fabric run which blade (31) is arranged to act against the fabric (9) to wipe off water from the fabric (9) and guide water that has been wiped from the fabric (9) into the pan (30).

11. A drying section (2) according to claim 10, wherein the pan (30) has a bottom wall (32) that faces the fabric (9) and at least one shower (33) is arranged to wash away fibre residue from the bottom wall (32).

12. A drying section (2) according to claim 1, wherein:

the drying section (2) has a machine direction (MD) defined as the direction in which it is arranged to carry the fibrous web (W) through itself, and the drying section (2) further comprises a Yankee drying cylinder (16) with a smooth outer surface (27) and in which the fabric (9) is arranged to transfer the fibrous web (W) at the transfer point (15) to either the smooth outer surface (27) of the Yankee drying cylinder (16) or to a transfer fabric arranged to carry the fibrous web (W) from the transfer point (15) to the smooth outer surface (27) of the Yankee drying cylinder (16), the conditioning part (11) of the fabric loop is located in a position vertically above the web-carrying part (10) of the fabric loop and a suction and blowing device (29) is placed in an area above the conditioning part (11) of the fabric loop and arranged to suck in air from an area above the conditioning part (11) of the fabric loop top and blow the air away in a direction which is horizontal and perpendicular to the machine direction (MD).

* * * * *